United States Patent [19]

Ishiguro

[11] Patent Number: 4,660,260

[45] Date of Patent: Apr. 28, 1987

[54] BUCKLE DEVICE

[75] Inventor: Kazuyoshi Ishiguro, Aichi, Japan

[73] Assignee: Kabushiki Kaisha Toka-rika-denki-seisakusho, Japan

[21] Appl. No.: 865,101

[22] Filed: May 20, 1986

[30] Foreign Application Priority Data

May 22, 1985 [JP] Japan ..... 60-76075[U]

[51] Int. Cl.[4] ..... A44B 11/25

[52] U.S. Cl. ..... 24/637; 24/638; 24/651

[58] Field of Search ..... 24/637, 636, 638, 643, 24/651

[56] References Cited

U.S. PATENT DOCUMENTS

| | | | |
|---|---|---|---|
| 3,237,258 | 3/1966 | Fisher | 24/637 |
| 3,277,548 | 10/1966 | Fisher | 24/637 |
| 3,364,531 | 1/1968 | Moss | 24/637 |
| 3,465,393 | 9/1969 | Fisher | 24/637 |
| 4,060,879 | 12/1977 | Takada | 24/637 |
| 4,377,888 | 3/1983 | Ikesue | 24/637 |
| 4,587,696 | 5/1986 | Ueda et al. | 24/637 |

*Primary Examiner*—Victor N. Sakran

*Attorney, Agent, or Firm*—Sixbey, Friedman & Leedom

[57] ABSTRACT

A buckle device is adapted to retain a tongue plate inserted thereinto by a lock plate. The lock plate is supported by a leaf spring member and biased in a direction in which it is engaged with the tongue plate. The leaf spring member is integrally formed with an ejector which biases the inserted tongue plate counter to a direction in which it is inserted into the buckle device. Accordingly, the buckle device is readily assembled, and the number of required parts is reduced.

4 Claims, 3 Drawing Figures

BUCKLE DEVICE

BACKGROUND OF THE INVENTION

1. Field of the Invention

The present invention relates to a buckle device used in combination with a tongue plate.

2. Description of the Related Art

A general seatbelt system mounted on an automobile is provided with a buckle device used when an occupant fastens and unfastens an occupant restraining webbing.

This type of buckle device is preferably reduced in size with a view to minimizing the space required for it and thus allowing the occupant to be seated comfortably. However, if the size of the buckle device is reduced, the labor required to assemble it when manufactured is increased, and it may become difficult for the occupant to actuate the buckle device smoothly and effectively when he fastens and unfastens the webbing.

SUMMARY OF THE INVENTION

In view of the above-described circumstances, it is a primary object of the present invention to provide a buckle device which is so designed that, even when the size of the buckle device is reduced, it is readily assembled in manufacture, and it can be smoothly and effectively operated in actual use.

To this end, the present invention provides a buckle device comprising: a buckle body having a pair of leg plate portions respectively provided with substantially sectorial through-holes which oppose each other, and a base plate portion which connects the pair of leg plate portions; a lock plate having a tongue plate retaining portion, the lock plate extending through the pair of through-holes so that it is pivotally disposed in the buckle body; and a leaf spring member retained by the buckle body to retain the lock plate in such a manner as to bias the lock plate toward the base plate portion of the buckle body and also bias the tongue plate counter to a direction in which the tongue plate is inserted into the buckle body.

By virtue of the above-described arrangement, the leaf spring member is retained by the buckle body in a state wherein the leaf spring member retains the lock plate. The lock plate is therefore positioned with respect to the buckle body simply by mounting the leaf spring member having the lock plate retained thereby in the buckle body. In addition, the leaf spring member also serves to bias the lock plate toward a pivotal portion thereof which is located on the upstream side of the lock plate in terms of a direction in which the tongue plate is inserted into the buckle body. Accordingly, when the tongue plate is inserted, the lock plate is smoothly pivoted.

DESCRIPTION OF THE PREFERRED EMBODIMENT

Figure 1:
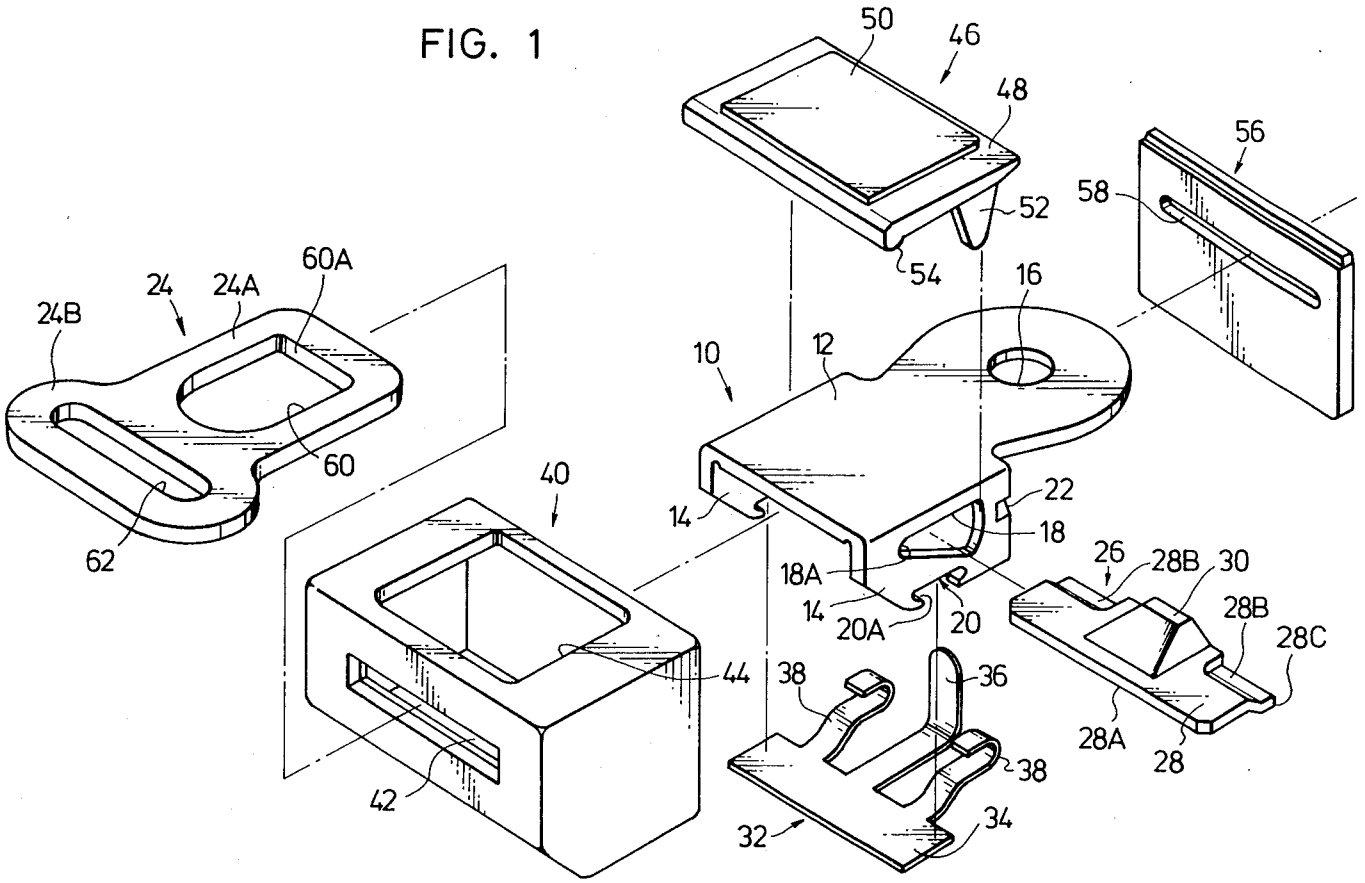
FIG. 1 is an exploded perspective view of one embodiment of the buckle device according to the present invention.
Figure 2:
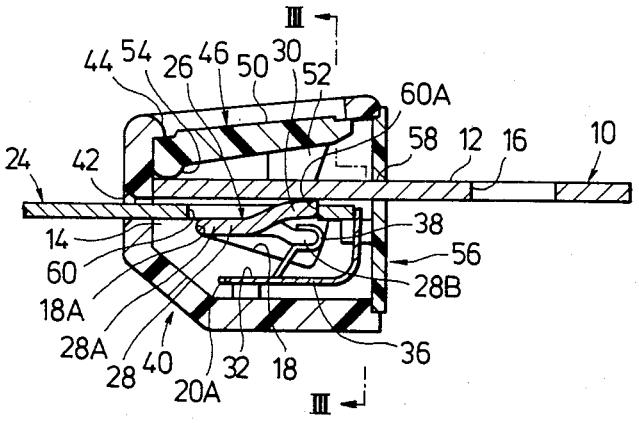
FIG. 2 is a sectional side view of the buckle device shown in FIG. 1.
Figure 3:
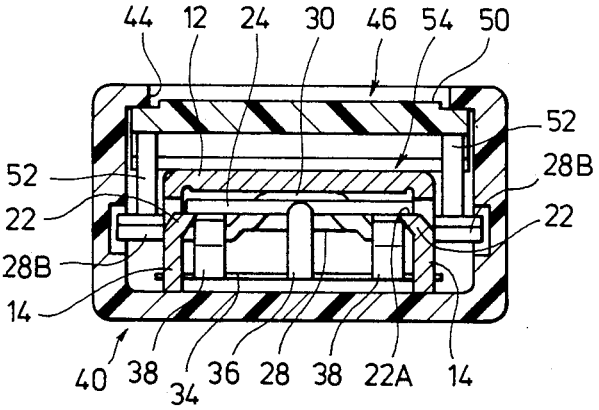
FIG. 3 is a sectional view taken along the line III—III in FIG. 2.

FIGS. 1 to 3 show in combination one embodiment of the buckle device according to the present invention.

Referring first to FIG. 1, a buckle body 10 has a base plate portion 10 including a portion which is rectangular in plan view and an extending portion which extends from one end of the rectangular portion, and a pair of leg plate portions 14 respectively defined by side portions of the buckle body 10 which are bent at substantially right angles so as to extend downwardly from two lateral ends of the base plate portion 12. A circular through-hole 16 is provided in the extending portion of the base plate portion 12 so that the through-hole 16 is used when the buckle body 16 is mounted on a vehicle such as an automobile. Substantially sectorial through-holes 18 are respectively provided in the leg plate portions 14 so that the through-holes 18 oppose each other. One corner 18A of each of the through-holes 18 has a circular shape. Notches 20 are formed in the respective lower ends of the leg plate portions 14 so that the notches 20 oppose each other. In addition, cut and projected portions 22 are provided at the respective rear (in this specification, the side of the buckle device from which a tongue plate, described later, is inserted is defined as the front side) ends of the leg plate portions 14 so that the portions 22 oppose each other.

Each of the notches 20 has a substantially T-shaped cross-section, and the inner part of the notch 20 defines a spring fitting portion 20A. The cut and projected portions 22 project toward each other as shown in FIG. 3. The clearance between the upper surface 22A of each portion 22 and the undersurface of the base plate portion 12 is set such as to be larger than the thickness of a tongue plate 24 which is used in combination with the buckle device according to the present invention.

As shown in FIG. 1, a lock plate 26 has a support plate portion 28 and a tongue plate retaining portion 30 which is formed in the lateral center of the support plate portion 28 by means of embossing. One end face of the support plate portion 28 is rounded so as to have a circular cross-section, thus providing a pivotal portion 28A. The other end of the support plate portion 28 is bent so that two steps are respectively formed on both sides of the retaining portion 30, thereby providing leaf spring engaging portions 28B. The lock plate 26 is inserted through the through-holes 18 provided in the buckle body 10 as shown in FIG. 2, and is disposed in the buckle body 10 in such a manner that both lateral ends of the support plate portion 28 project outwardly from the buckle body 10 as shown in FIG. 3.

As will be clear from FIG. 1, a leaf spring member 32 has a rectangular flat plate portion 34, a central leg portion 36 which extends from the lateral center of the flat plate portion 34, and a pair of side leg portions 38 which respectively extend from positions on the flat plate portion 34 on both sides of the central leg portion 36. The central leg portion 36 is bent at its intermediate portion at substantially right angles so that the distal end portion thereof extends upwardly. Each of the side leg portions 38 is bent upwardly so as to have a substantially step-like configuration, and the distal end portion thereof is bent so as to have a substantially U-shaped configuration. The leaf spring member 32 is set in the buckle body 10 in such a manner that, as shown in FIGS. 2 and 3, the distal end portion of each of the side leg portions 38 is engaged with the corresponding leaf spring engaging portion 28B, and both lateral ends of the flat plate portion 34 are respectively fitted into the leaf spring fitting portions 20A of the buckle body 10 so as to be retained thereby.

The lock plate 26 in this state is retained by the leaf spring member 32 and set in position within the buckle body 10. Further, the lock plate 26 is biased by the leaf spring member 32 such that the pivotal portion 28A is pressed against the respective corners 18A of the through-holes 18. In addition, the lock plate 26 is pivoted upwardly about the pivotal portion 28A, so that the upper surface of the support plate portion 28 is pressed against the respective upper end faces of the through-holes 18.

As shown in FIG. 1, a buckle cover 40 has the shape of a casing the rear side of which is open. A rectangular through-hole 42 for passing the tongue plate 24 is provided in the front wall of the buckle cover 40. Further, a rectangular through-hole 44 for allowing an occupant to operate a release button 46 (described later) is provided in the upper wall of the buckle cover 40.

As shown in FIG. 1, the release button 46, which constitutes disengaging means, has an integral structure which is composed of a base portion 48 having a rectangular shape in plan view, an operating portion 50 projecting upwardly from the base portion 48 and having the shape of a rectangle in plan view which is smaller than the above-described through-hole 42, a pair of substantially triangular leg portions 52 extending downwardly from two lateral ends, respectively, of the base portion 48, and a pivotal portion 54 projecting from the reverse surface of the front end of the base portion 48 and having a circular cross-section. The release button 46 is, as shown in FIG. 2, mounted in the buckle cover 40 in such a manner that the periphery of the upper surface of the base portion 48 is brought into contact with the inner surface of the upper wall of the buckle cover 40 around the through-hole 44, and the operating portion 50 is positioned within the throughhole 44.

The buckle body 10 is mounted in the buckle cover 40 having the release button 46 mounted therein, as shown in FIGS. 2 and 3. Each of the leg portions 52 of the release button 46 is, as shown in FIG. 3, pressed against the upper surface of the support plate portion 28 of the lock plate 26 mounted in the buckle body 10. A subsidiary cover 56 is, as shown in FIG. 2, fitted to the buckle cover 40 having the buckle body 10 mounted therein in such a manner that the cover 56 closes the opening in the rear side of the buckle cover 40. As shown in FIG. 1, a rectangular through-hole 58 is provided in the subsidiary cover 56, and the rear portion (the extending portion) of the base portion 12 of the buckle body 10 extends through this through-hole 58 and projects outwardly from the buckle cover 40.

As shown in FIG. 1, the tongue plate 24 is composed of an insertion portion 24A and a larger-width portion 24B which is contiguous with the insertion portion 24A. A through-hole 60 which is engaged with the tongue plate retaining portion 30 of the lock plate 26 is provided in the insertion portion 24A. A through-hole 62 is provided in the larger-width portion 24B. A webbing (not shown) is passed through the through-hole 62. The buckle device is connected to a support member (not shown) which is made from a steel plate and which stands from the floor of the vehicle body, through a pin (not shown) which is received through the through-hole 16 in the base plate portion 12 of the buckle body 10.

The following is a description of the operation of this embodiment.

The tongue plate 24 is inserted into the buckle device from the left-hand side as viewed in FIG. 2. The tongue plate 24 passes through the through-hole 42 and advances along the reverse surface of the base plate portion 12 of the buckle body 10 until the tongue plate 24 abuts against the tongue plate retaining portion 30 of the lock plate 26. As the tongue plate 24 is further inserted, the tongue plate retaining portion 30 is pressed by the tongue plate 24, thus causing the lock plate 26 to pivot downwardly about the pivotal portion 28A against the biasing force from the leaf spring member 32. Since the lock plate 26 is also biased by the leaf spring member 32 toward the pivotal portion 28A, that is, counter to a direction in which the tongue plate 24 is inserted, the rear end portion of the lock plate 26, which is opposite to the pivotal portion 28A, is not in contact with the rear end face of the through-hole 18, so that the tongue plate 24 can pivot smoothly.

When the end face 60A of the through-hole 60 has passed the tongue plate retaining portion 30, the lock plate 26, which is biased by the leaf spring member 32, is allowed to pivot upwardly about the pivotal portion 28A, so that the upper surface of the support plate portion 28 is pressed against the reverse surface of the tongue plate 24. In this state, the tongue plate retaining portion 30 is positioned inside the through-hole 60.

Before reaching this state, the tongue plate 24 is brought into contact with the central leg portion 36 of the leaf spring member 32 and is inserted while pressing the central leg portion 36, thus causing the leg portion 36 to be elastically deformed. Accordingly, even when the tongue plate inserting operation is suspended after the tongue plate 24 has been inserted inwardly beyond the above-described engaging position, the tongue plate 24 is pushed back by virtue of the shape restoring force of the central leg portion 36, and the end face 60A of the through-hole 60 is pressed against the tongue plate retaining portion 30, as shown in FIG. 2. It should be noted that the distal end portion of the insertion portion 24A of the tongue plate 24 is supported by the undersurface of the base plate portion 12 of the buckle body 10 and the upper surface 22A of each of the cut and projected portions 22.

To disengage the tongue plate 24 from the buckle device, the operating portion 50 of the release button 46 is pressed. In consequence, the release button 46 is pivoted downwardly about the pivotal portion 54, and the leg portions 52 press downwardly the support plate portion 28 of the lock plate 26. Consequently, the support plate portion 28 is pivoted downwardly about the pivotal portion 28A. Thus, the tongue plate retaining portion 30 moves downwardly and comes out of the through-hole 60, so that the tongue plate 24 is pressed counter to the tongue plate inserting direction by virtue of the shape restoring force of the central leg portion 36 of the leaf spring member 32 and thereby disengaged from the buckle device.

Thus, in this embodiment the central leg portion 36 of the leaf spring member 32 carries out an ejector function, and this leads to a reduction in the number of required parts and also in the number of required assembling steps.

Since the leaf spring member 32 also serves as a member for retaining the lock plate 26 to the buckle body 10, the lock plate 26 is positioned with respect to the buckle body 10 simply by mounting the leaf spring member 32 in the buckle body 10, together with the lock plate 26, so that the assembling operation carried out in subsequent steps is facilitated.

In addition, the leaf spring member 32 also serves to bias the lock plate 26 counter to a direction in which the tongue plate 24 is inserted. It is therefore unnecessary to round the lower portion (denoted by the reference numeral 28C in FIG. 1) of the rear end of the lock plate 26, so that it is possible to partially omit the labor-consuming grinding step. Further, since the rear end portion of the lock plate 26 is not in slide contact with the rear end face of each of the through-holes 18, the tongue plate 24 can be smoothly inserted into the buckle body 10, and the release button 46 moves smoothly when pressed. Thus, the buckle device can be smoothly and effectively operated.

As has been described above, the buckle device according to the present invention is arranged such that the lock plate disposed in the buckle body is biased toward the base plate portion of the buckle body and is also biased counter to a direction in which the tongue plate is inserted by the action of the leaf spring member which is retained by the buckle body and which retains the lock plate. Accordingly, even when the size of the buckle device is reduced, it is readily assembled in manufacture, and it can be smoothly and effectively operated in actual use.

What is claimed is:

1. A buckle device used in combination with a tongue plate, which comprises:

(a) a buckle body having a pair of leg plate portions respectively provided with substantially sectorial through-holes which oppose each other, and a base plate portion which connects said pair of leg plate portions, wherein the distal end of said first leg portion is bent so as to have a substantially U-shaped configuration, said lock plate being clamped and thereby supported by said U-shaped bent portion, and said second leg portion is bent at its intermediate portion at substantially right angles in order to both abut against said tongue plate when inserted and to bias said tongue plate counter toward a direction in which said tongue plate is inserted into said buckle body, and wherein both of said leg plate portions have cut and projected portions provided at respective ends thereof which are closer to the distal end of said tongue plate inserted in said buckle body, said cut and projected portions extending toward each other, the distal end portion of said tongue plate inserted being supported by said cut and projected portions, and wherein each of said pair of leg plate portions further has a substantially T-shaped notch in the end thereof, the flate plate portion of said leaf spring member being fitted into said notch so as to be supported thereby;

(b) a lock plate having a tongue plate retaining portion which retains said tongue plate, said lock plate extending through said pair of through-holes so that said lock plate is pivotally disposed in said buckle body; and (c) a leaf spring member retained by said buckle body to retain said lock plate in such a manner as to bias said lock plate toward the base plate portion of said buckle body and also bias said tongue plate counter to a direction in which said tongue plate is inserted into said buckle body, wherein said leaf spring member has a flat plate portion which is retained by said buckle body, a first leg portion for supporting said lock plate, and a second leg portion for biasing said tongue plate counter to a direction in which said tongue plate is inserted into said buckle body, whereby, even when the size of said buckle device is reduced, it is readily assembled in manufacture, and it can be smoothly and effectively operated in actual use.

2. A buckle device used in combination with a tongue plate, which comprises:

(a) a buckle body having a pair of leg plate portions respectively provided with substantially sectorial through-holes which oppose each other, and a base plate portion which connects said pair of leg plate portions, wherein the distal end of said first leg portion is bent so as to have a substantially U-shaped configuration, said lock plate being clamped and thereby supported by said U-shaped bent portion, and said second leg portion is bent at its intermediate portion at substantially right angles in order to both abut against said tongue plate when inserted and to bias said tongue plate counter toward a direction in which said tongue plate is inserted into said buckle body;

(b) a lock plate having a tongue plate retaining portion which retains said tongue plate, said lock plate extending through said pair of through-holes so that said lock plate is pivotally disposed in said buckle body; and (c) a leaf spring member retained by said buckle body to retain said lock plate in such a manner as to bias said lock plate toward the base plate portion of said buckle body and also bias said tongue plate counter to a direction in which said tongue plate is inserted into said buckle body, wherein said leaf spring member has a flat plate portion which is retained by said buckle body, a first leg portion for supporting said lock plate, and a second leg portion for biasing said tongue plate counter to a direction in which said tongue plate is inserted into said buckle body, and (d) a release button for cancelling a state wherein said tongue plate is retained by said lock plate, wherein said button has projections respectively provided at edges thereof which extend in a direction substantially parallel to said tongue plate inserting direction, said projections respectively extending toward portions of said lock plate which extend through said through-holes in said buckle body, whereby, when said release button is pressed, the engagement between said lock plate and said tongue plate is cancelled.

3. A buckle device used in combination with a tongue plate, which comprises:

(a) a buckle body having a pair of leg plate portions respectively provided with substantially sectorial through-holes which oppose each other, and a base plate portion which connects said pair of leg plate portions, wherein the distal end of said first leg portion is bent so as to have a substantially U-shaped configuration, said lock plate being clamped and thereby supported by said U-shaped bent portion, and said second leg portion is bent at its intermediate portion at substantially right angles in order to both abut against said tongue plate when inserted and to bias said tongue plate counter to a direction in which said tongue plate is inserted into said buckle body, and wherein both of said pair of leg plate portions have cut and projected portions provided at respective ends thereof which are closer to the distal end of said tongue plate inserted in said buckle body, said cut and projected portions extending toward each other, the distal end portion of said tongue plate inserted being supported by said cut and projected portions, and wherein each of said pair of leg plate portions has a substantially T-shaped notch in the end thereof, the flat plate portion of said leaf spring member being fitted into said notch so as to be supported thereby;

(b) a lock plate having a tongue plate retaining portion formed by embossing an approximately central portion of said lock plate which retains said tongue plate, said lock plate extending through said pair of through-holes so that said lock plate is pivotally disposed in said buckle body;

(c) a leaf spring member retained by said buckle body and integrally formed with means for retaining said lock plate and biasing said lock plate toward the base plate portion of said buckle body and means for biasing said tongue plate counter to a direction in which said tongue plate is inserted into said buckle body, wherein said leaf spring member has a flat plate portion which is retained by said buckle body, a first leg portion for supporting said lock plate, and a second leg portion for biasing said tongue plate counter to a direction in which said tongue plate is inserted into said buckle body, and (d) a release body for cancelling a state wherein said tongue plate is retained by said lock plate, whereby, even when the size of said buckle device is reduced, it is readily assembled in manufacture, and it can be smoothly and effectively operated in actual use.

4. A buckle device according to claim 3, wherein said release button has projections respectively provided at edges thereof which extend in a direction substantially parallel to said tongue plate inserting direction, said projections respectively extending toward portions of said lock plate which extend through said through-holes in said buckle body whereby, when said release button is pressed, the engagement between said lock plate and said tongue plate is cancelled.

* * * * *